US006257569B1

(12) United States Patent
Rhodes et al.

(10) Patent No.: US 6,257,569 B1
(45) Date of Patent: Jul. 10, 2001

(54) APPARATUS AND METHOD FOR DELIVERY OF SHEET MEDIA TO A PRINTER

(75) Inventors: John D. Rhodes, Vancouver; Robert M. Yraceburu, Camas, both of WA (US); Angela Chen, Portland, OR (US); Steve O Rasmussen, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/256,851

(22) Filed: Feb. 24, 1999

(51) Int. Cl.[7] ..... B65H 3/06

(52) U.S. Cl. ..... 271/117; 271/10.11; 271/10.03; 271/10.04; 271/110; 271/114; 271/115; 271/127; 271/126; 271/121; 271/124; 271/123; 271/118

(58) Field of Search ..... 271/10.11, 10.03, 271/10.04, 110, 114, 115, 117, 127, 12 C, 121, 124, 118, 123

(56) References Cited

U.S. PATENT DOCUMENTS 4,893,152 * 1/1990 Ishiguro et al. ..... 399/403
5,052,676 * 10/1991 Shiina et al. ..... 271/121
5,386,983 * 2/1995 Ando ..... 271/118
5,882,004 * 3/1999 Padget ..... 271/119
5,984,297 * 11/1999 Tanaka ..... 271/118
6,042,103 * 3/2000 Yraceburu et al. .
6,073,923 * 6/2000 Lin et al. ..... 271/10.03

OTHER PUBLICATIONS

U.S. Pat. 6,042,103.

* cited by examiner

*Primary Examiner*—Donald P. Walsh
*Assistant Examiner*—Jonathan R Miller

(57) ABSTRACT

An apparatus and method for delivery of sheet media to a printer includes a chassis, a drive motor, a media tray with elevatable pressure plate, a plurality of pick rollers situated opposite movable pinch rollers that come into contact with the pick rollers to form a roller assembly therebetween when in an extended position. A movable separator forms a throat between one of the pick rollers and the leading edge of the separator when it is in an extended position. A common transmission is used to simultaneously position the pinch rollers, separator, and the pressure plate. The apparatus also includes a media retarder for preventing multiple sheets of media from advancing through the apparatus at the same time. The method includes delaying the rotation of the pick rollers until a stack of media has been raised to press against the pick rollers, and the pinch rollers and separator are in an extended position. The pinch rollers and separator are retracted, and the transmission is disengaged from the pick rollers once the media sheet is delivered to a printer feed system.

17 Claims, 12 Drawing Sheets

FIG. 1
(Prior Art)
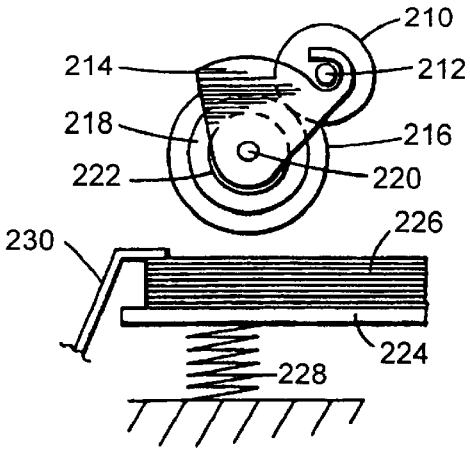
FIG. 2
(Prior Art)
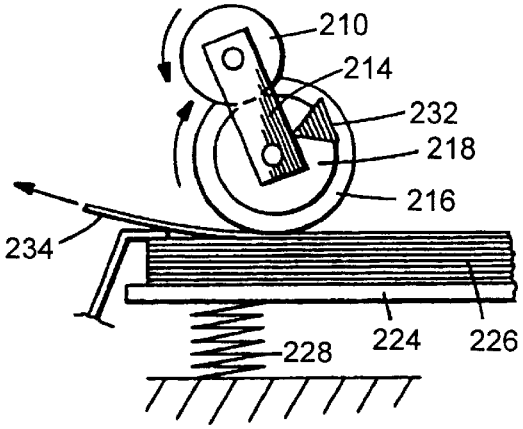
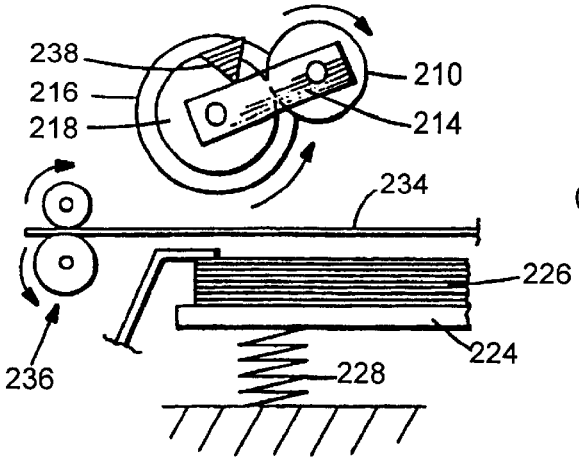
FIG. 3
(Prior Art)

APPARATUS AND METHOD FOR DELIVERY OF SHEET MEDIA TO A PRINTER

FIELD OF THE INVENTION

The present invention relates to printing systems, and more particularly relates to sheet feeder apparatus for delivery of print media to printers.

BACKGROUND OF THE INVENTION

Sheet media delivery apparatus are used to deliver print media to printers. These apparatus are often incorporated into auxiliary bin sheet feeders, which are typically used to increase the media delivery capacity of nominally low-capacity inkjet or laser printers. They also are commonly used as part of an overall media transport system in large-capacity office printers and copier systems.

Various auxiliary bin sheet feeders were developed for many of the early laser printers, such as the Hewlett-Packard "LASERJET" II and "LASERJET" III printers. Since these printers were fairly large (in comparison to today's laser printers), the overall size of the auxiliary bin sheet feeders could also be fairly large without appearing out of place or taking up excessive room on a desk or printer stand that was sized to accommodate the printer.

Today's contemporary laser printers and inkjet printers are much smaller than their predecessors. However, the demand for increased media-handling capacities remains as strong as ever. In parallel with this reduction in printer size, office and consumer markets have also demanded a reduction in the size of the auxiliary bin sheet feeders that work with the newer printers.

A reduction in overall size of an auxiliary bin sheet feeder requires a reduction in the media delivery system. The media delivery system typically performs two functions. First, a sheet of media must be "picked" off of a stack of media. It is desired to pick a single sheet of media at time, which is known as "singulation." The second function of the media delivery system is to advance the picked sheet of media into a printer media feed system.

A common problem generally encountered in media delivery systems is "multipicking." Multi-picking may occur when underlying sheets in the stack are partially "dragged" out of the tray by the picking of sheets above. Many conventional media delivery systems are designed to provide minimal drag on the media sheet after it has entered the feed mechanism of the printer. While minimizing drag improves media alignment and positional accuracy in the printer, retracting the separator pad can create another type of multi-picking known as a "trailing pick." A trailing pick is caused when an underlying sheet is dragged by a sheet above it (generally the picked sheet) as the picked sheet is transported through the media delivery system.

A common technique for performing the pick operation employs a D-shaped wheel (D-wheel) that is rotated to cause a media sheet pick action. As the D-wheel is rotated, its curved portion contacts the media, urging it forward. As the D-wheel is further rotated it falls out of contact with the media at its flattened portion, allowing an upstream media transport mechanism to advance the media without resistance from the D-wheel. This arrangement is satisfactory so long as the media sheet is not bent around the D-wheel shaft during a feed operation. This situation may occur when the media tray is positioned at an angle relative to the feed mechanism. If the media sheet presses against the D-shaped wheel, significant drag on the media sheet results. Therefore, D-wheel systems are generally impractical for use in feed systems that require the media to be bent as it is fed to the printer, a common condition when auxiliary bin feeders are used with today's smaller printers.

The use of a D-wheel is also impractical for use in a low-profile auxiliary feed system applications that require the sheet media to be advanced a fair distance prior to entering the printer feed mechanism. For instance, a typical feed system may employ a D-wheel with a nominal diameter of about 2 inches (50 mm). Since about ¾ of the perimeter of the D-wheel contacts the media during a feed operation, a D-wheel of this size can advance the media about 5 inches. In comparison, the D-wheel diameter of a low-profile auxiliary feed mechanism may be limited to about half this size. Such a reduced-size wheel can only advance the media about 2.5 inches, which is insufficient in most applications.

Another typical pick and feed arrangement is shown in FIGS. 1–3, which illustrate a pick roller system employed in a media sheet feed mechanism manufactured by the Epson Corporation. As shown in FIG. 1, the system comprises a pick roller 216 that is driven by a drive gear 210 mounted on a shaft 212, which in turn is coupled to a drive motor (not shown). A pivot arm 214 is mounted for rotation about shaft 212 and encloses a rubber pick roller 216. A driven gear 218 mates with drive gear 210, is rigidly connected to pick roller 216, and is mounted for rotation on a shaft 220. A spring washer 222 is positioned between an inner surface of arm 214 and driven gear 218, and performs a friction clutch function.

The pick and feed system is positioned above a media tray including a pressure plate 224 which supports a stack of media sheets 226. The tray is biased by a spring 228 into contact with the pick roller 216. An edge separator 230 is positioned to maintain an uppermost sheet on stack 226 in place until operation of the rubber pick roller 216.

The pick operation is illustrated in FIGS. 2 and 3. To implement a pick operation, drive gear 210 is driven in a counterclockwise (CCW) direction, thereby causing driven gear 218 to rotate in a clockwise (CW) direction. Due to the friction exerted by spring washer 222, arm 214 and pick roller 216 are caused to rotate in a CCW direction until arm 214 hits stop 232. This action causes pick roller 216 to come into contact with a top sheet 234 of stack 226. The top sheet is forced against pick roller 216 through the action of spring 228 on tray 224. Continued clockwise rotation of the pick roller 216 feeds the top sheet 234 from the stack 226.

As shown in FIG. 3, when the top sheet 234 is grabbed by a pair of feed rollers 236, the direction of rotation of the driven gear 210 is reversed to a CW direction, thereby causing the arm 214 and pick roller 216 to rotate in a CCW direction and out of engagement with the top sheet. The CCW rotation of pick roller 216 is required as the clutching action of spring washer 222 otherwise would cause pick roller 216 to impede the feeding of the top sheet. The CCW rotation of the arm 214 and pick roller 216 continues until the arm 214 hits a second stop 238.

The prior art device of FIGS. 1–3 is generally too large to be used in a low-profile auxiliary bin sheet feeder. In order to meet the height restrictions necessitated by the lower profile, the size of the pick roller and drive gear must be reduced, which adversely impacts the pick and feed performance. Furthermore, the positioning of the feed rollers adds extra length to the overall size of the feed system.

Reduced-size media delivery systems present other problems that are not generally encountered with larger systems. One such problem is that the size (diameter) of the drive motor on these systems may be limited. A drive motor with a 50% reduction in diameter may have 25% of the torque of a comparable full-size motor. As a result, the torque available to drive the system may be dramatically reduced.

In addition to the foregoing problems, the media feed system needs to be able to handle media that is not completely flat. Humidity will often cause media sheets to become corrugated in that the sheets have ripples or waves formed in them and are no longer flat. Corrugated sheets pose a problem for conventional feed systems because they have a tendency to jam, rip or become skewed when they enter a feed-roller assembly subsequent to being picked.

Therefore a need exists for an improved reduced-size auxiliary bin feeder and associated media delivery system. It is further desired to have a media delivery system that reduces multi-picks and trailing picks, and reduces the adverse effect of wavy media sheets. It is additionally desired to provide a media delivery system that requires less motor torque.

SUMMARY OF THE INVENTION

The above and other desired features are achieved in accordance with the present invention which, according to a first aspect of the invention, is exemplified by an apparatus for delivering a sheet media to a printer. The apparatus includes a plurality of pick rollers, a plurality of moveable pinch rollers, and a mechanism for raising a stack of sheet media. In a preferred operational sequence, the stack of sheet media is raised so that the top sheet of media is urged into pressure contact with the pick rollers, thereby flattening the leading edge of the media in the areas that contact the pick rollers. Preferably in conjunction with the raising of the media, the pinch rollers are extended until they contact the pick rollers, thereby forming a roller assembly with a nip therebetween. The pick rollers are then rotated so as to pick the top sheet of media, and continued to be rotated so as to transport the top sheet through the roller assembly into a printer.

According to another aspect of the invention, an auxiliary bin sheet feeder is disclosed comprising a chassis having a drive motor and a media tray. A plurality of pick rollers are mounted to the chassis adjacent to opposing extendable pinch rollers, forming a roller assembly therebetween when the pinch rollers are extended to be in contact with the pick rollers. The media tray includes a pressure plate that can be raised to lift a stack of media so that it may be "picked" by the pick rollers. An extendable media separator is situated adjacent to one of the pick rollers, and serves the purpose of reducing multiple picks. The motor preferably is connected to a transmission including multiple gear trains for driving the pick rollers, pinch roller and separator extension mechanisms, and a pressure plate lifting mechanism. The pinch roller and separation extension mechanisms preferably comprise a common camshaft that causes the pinch rollers and the separator to extend when the camshaft is rotated. The pressure plate lifting mechanism preferably comprises a linkage connected to the transmission. A transmission crank gear preferably is commonly connected to the camshaft and the lift linkage. The transmission preferably is designed so that the pick rollers do not rotate until the pressure plate is raised and the pinch rollers and separator are in their extended positions. In addition, the transmission is preferably designed to disengage the pinch roller and separator extension mechanisms once the pinch roller and separator are extended, permitting the majority of the motor torque to be available to advance the media through the feeder. A media retarder, situated in close proximity to the separator, preferably is used to prevent more than one sheet of media at a time from advancing through the roller assembly subsequent to a pick operation. A paper kicker may optionally be used to push back the leading edges of the media sheets toward the top of the media stack so that the media sheets come into contact with the pick rollers at a consistent position. The paper kicker also is used to push sheets off of the media retarder and separator when additional sheets of media are added to the media tray.

In a preferred operational sequence of the sheet feeder, the pressure plate is lifted to raise a stack of sheet media, urging a top sheet of the media into contact with the pick rollers. Preferably in conjunction with the lifting operation, the pinch rollers are extended so that they come into contact with the pick rollers. At the same time, the separator is extended so that a rearward portion of the separator comes into contact with one of the pick rollers so as to form a throat between a forward portion of the separator and the pick roller. Once all of the foregoing events have occurred, the pinch roller and separator extension mechanisms are disengaged from the transmission, as well as the pressure plate lifting mechanism, and the transmission engages and drives the pick rollers so as to pick the top sheet of media in the media stack. As the media is picked, its leading edge is moved into the throat, whereby "singulation" is performed. The leading edge then proceeds through the roller assembly so as to transfer the media sheet towards a printer feed mechanism. An edge sensor preferably is used to sense when the media sheet has entered the printer feed mechanism. At this point the drive motor is reversed so as to cause the transmission to disengage the pick rollers and reengage the mechanisms to retract the pinch rollers and separator so that the printer feed mechanism can advance the media sheet without resistance from the roller assembly.

The invention can be used in an auxiliary media feed apparatus that is attachable to a printer, or as part of a built-in printer feed system.

These and other features and advantages of the invention are described in detail below in the following detailed description and accompanying drawings.

BRIEF DESCRIPTION OF THE DRAWINGS

FIG. 1 is a side view of a prior art pick roller mechanism.

FIG. 2 is a schematic side view of the pick roller mechanism of FIG. 1 during a pick action.

FIG. 3 is a schematic side view of the pick roller mechanism of FIG. 1 after the pick action and during a sheet feed.

FIG. 13(*c*) is an elevational view for illustrating the media incidence angle.

DETAILED DESCRIPTION

Figure 4:
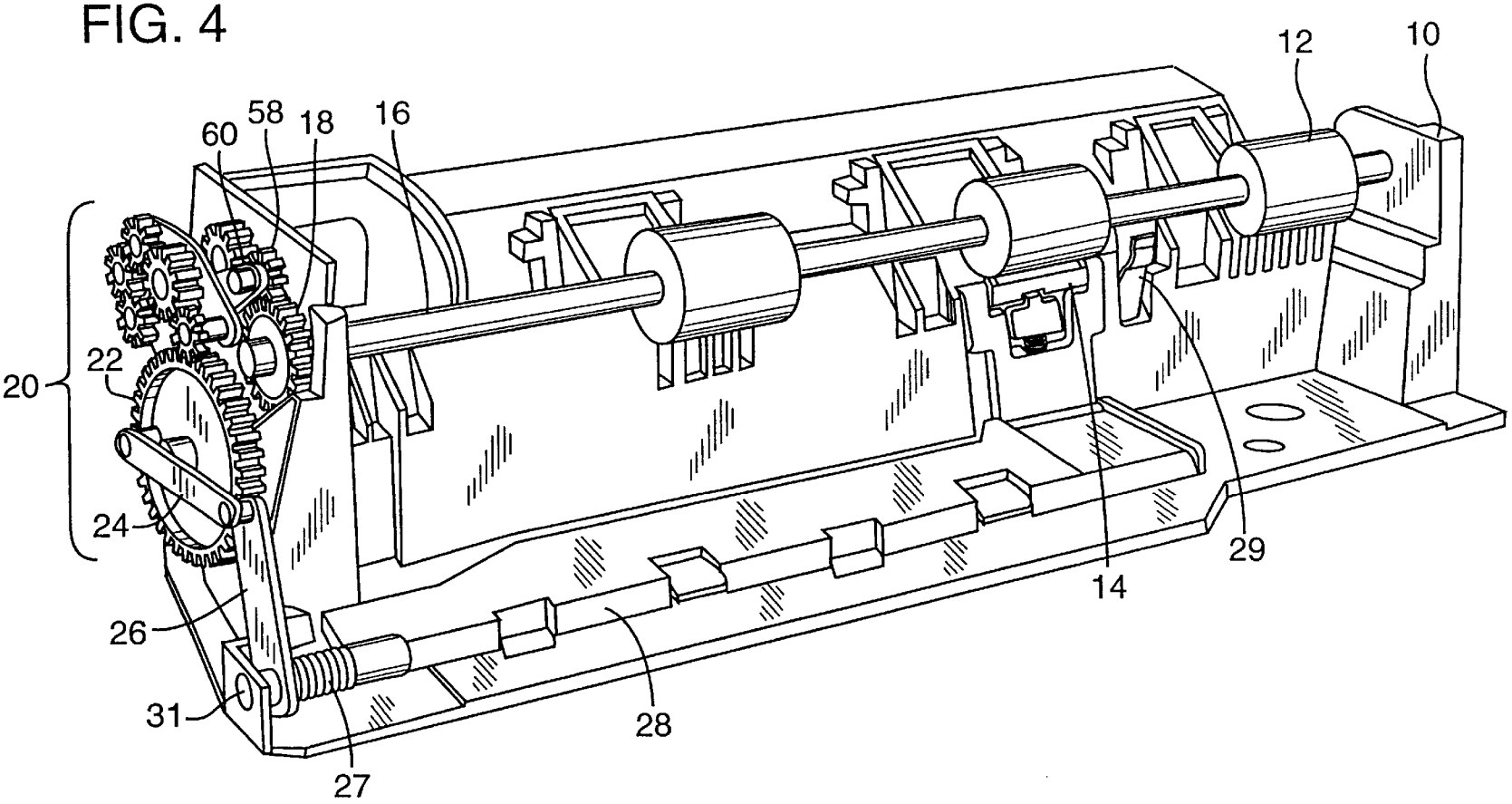
FIG. 4 is an isometric view showing an exemplary media delivery apparatus according to the present invention.

An exemplary media delivery apparatus in accordance with the present invention is shown in FIG. 4. The apparatus includes a chassis 10, which rotatably supports a pick roller shaft 16 at opposite ends of the shaft. Multiple pick rollers 12 are 30 mounted on the pick roller shaft 16, and a pick gear 18 is connected to the shaft at one of its ends. A media separator 14 is pivotally coupled to the chassis 10, and situated adjacent one of the pick rollers 12. A gear train 20, including a crank gear 22, is coupled to a link 24, which in turn is coupled to a rocker 26. The rocker 26 is coupled to a shaft 31, which in turn is coupled to a lifter 28 through a torsion spring 27. The apparatus also optionally includes a paper kicker 29 that is pivotally mounted to the chassis 10.

Figure 5:
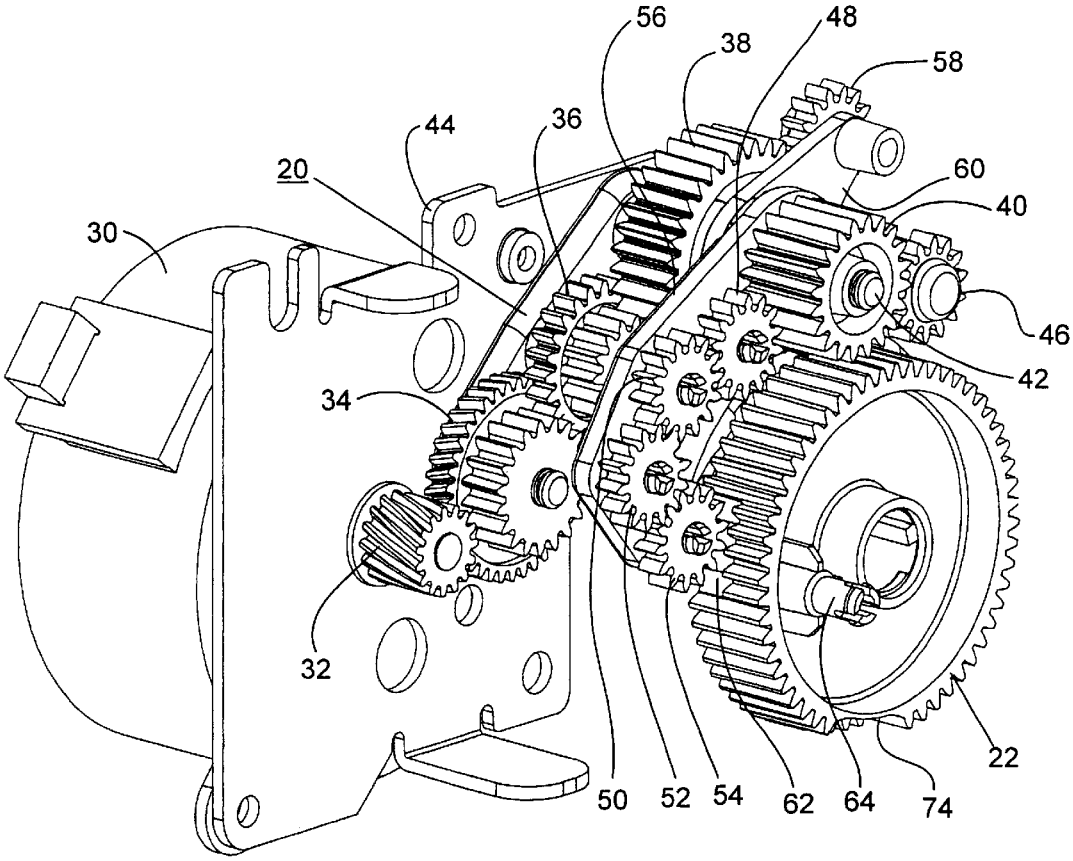
FIG. 5 is an isometric view of the drive mechanism of the FIG. 4 apparatus.

FIG. 5 shows an isometric view of the gear train 20. Motor 30 turns drive gear 32, which drives speed-reducing gears 34 and 36. The gear 36 drives gears 38 and 40. The gears 38 and 40 are concentric gears that are joined so that they rotate in tandem about a common shaft 42 that is affixed to motor mount 44. Gear 40 simultaneously drives pinion gear 46 and gear 48. Gears 48, 50, 52, and 54 form a gear train with gear 54 as the output drive gear. The gears 46, 48, 50, 52, and 54 are commonly mounted to crank arm 56. Pinion gear 58 is mounted on pick arm 60 and driven by gear 38. Pinion gear 58 engages pick gear 18 (see FIG. 4) when the pick arm 60 is rotated to a pick gear driving position, as explained below.

Figure 6A:
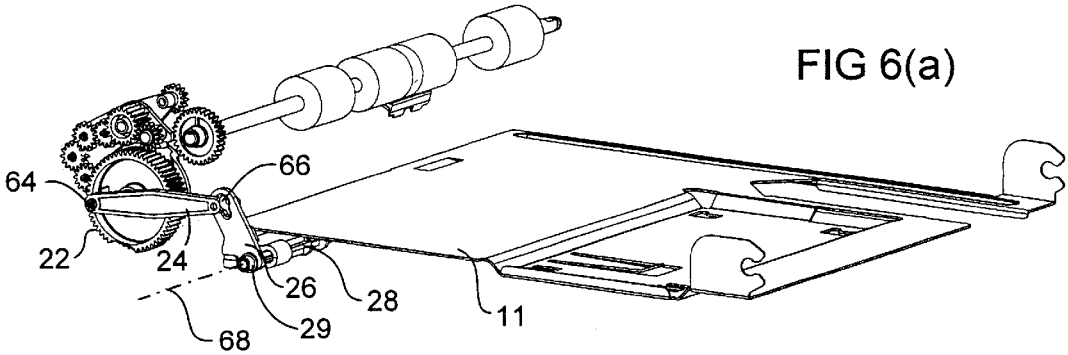
FIGS. 6(*a*) and 6(*b*) respectively show isometric and elevational views of the drive assembly and pressure plate of the FIG. 4 apparatus, with the pressure plate in the paper-down position.
Figure 6B:
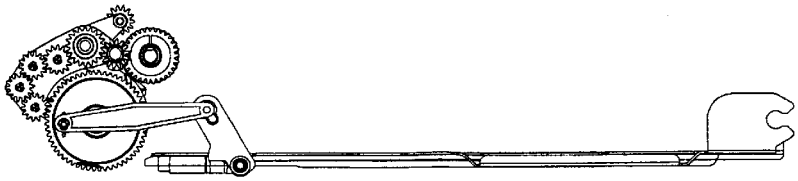

The media delivery apparatus additionally includes a pressure plate 11 that is used to support a stack of media, as shown in FIGS. 6(*a*)–7(*b*). The forward end of the pressure plate 11 is supported by the lifter 28, enabling the pressure plate to be raised to a "paper-up" position (FIGS. 7(*a*)–(*b*)) and lowered to a "paper-down" position (FIGS. 6(*a*)–(*b*)) as the lifter 28 is rotated about axis 68. The link 24 is connected to the crank gear 22 at pivot 64, and connected to the rocker 26 at pivot 66. The rocker 26 is connected to the shaft 31, and shaft 31 is coupled to lifter 28 through torsion spring 27, causing the lifter 28 to pivot about axis 68. The combination of the crank gear 22, the link 24, the rocker 26, and their associated pivots form a four-bar linkage.

Figure 7A:
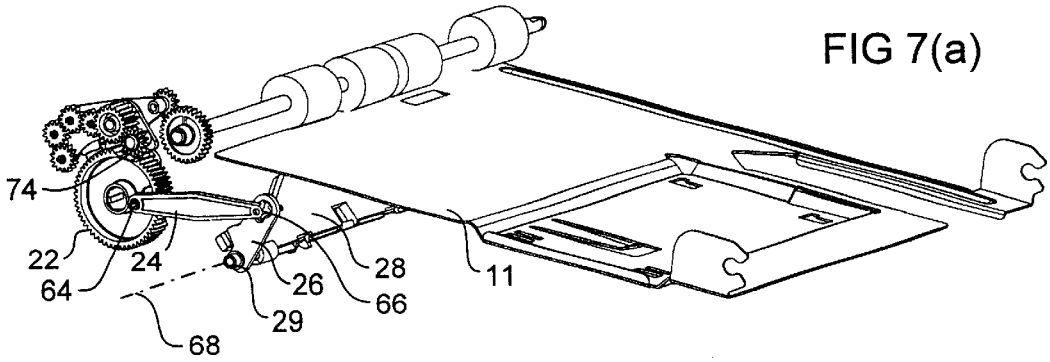
FIGS. 7(*a*) and 7(*b*) respectively show isometric and elevational views of the drive assembly and pressure plate of the FIG. 4 apparatus, with the pressure plate in the paper-up position.
Figure 7B:
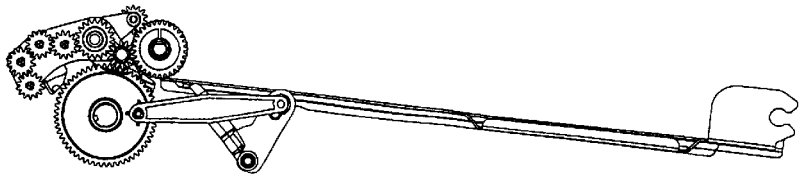
Figure 8A:
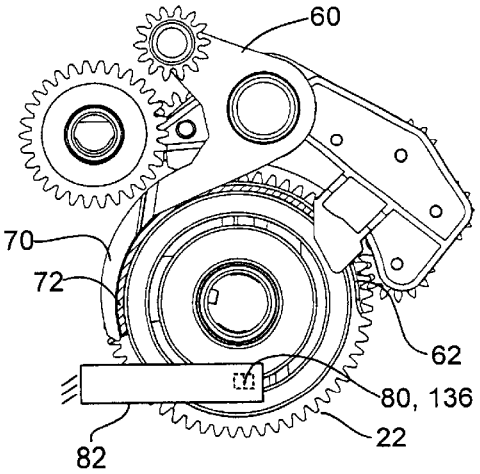
FIGS. 8(*a*) and 8(*b*) show elevation views of the drive mechanism gear assembly from the front and back sides, respectively, when the pressure plate is in the paper-down position.
Figure 8B:
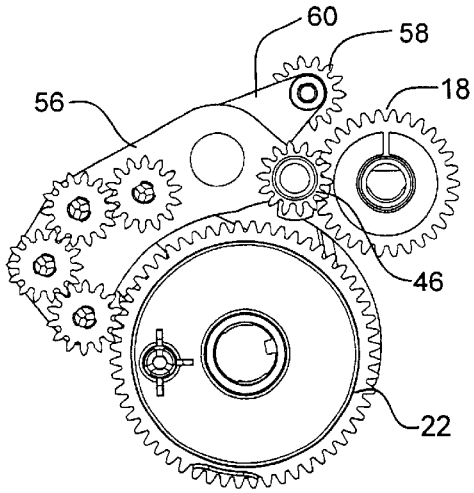
Figure 9A:
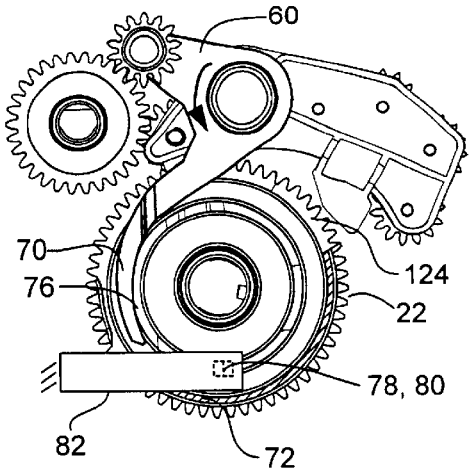
FIGS. 9(*a*) and 9(*b*) show elevation views of the drive mechanism gear assembly from the front and back sides respectively as the lifter 28 is being rotated to lift the pressure plate 11 to the paper-up position.
Figure 9B:
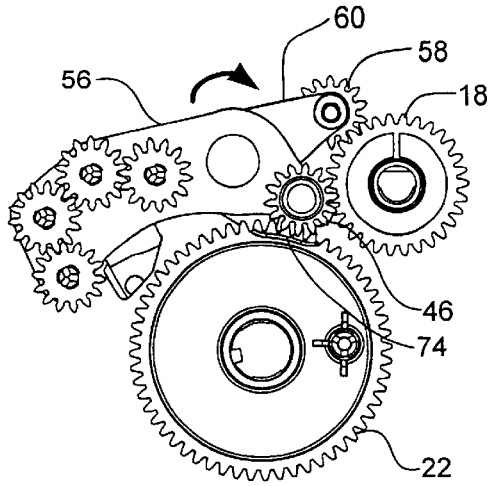

The following discusses the operation of the gear assembly during the lifting of the pressure plate 11. With reference to FIGS. 5, 8(*a*) and 10, a relief 62 is cut into the crank gear 22 at about one-half of the gear teeth depth so that gear 54 cannot drive the crank gear 22 when the pressure plate is in a paper-down position. To lift the pressure plate, the motor 30 is rotated counterclockwise as viewed in FIG. 5. The angular direction and velocity of the motor 30 is controlled by a motor controller which may be located in the media delivery apparatus, or in a printer to which the apparatus is coupled. Rotating the motor 30 counterclockwise causes the gears in the assembly to be driven so as to rotate crank arm 56 clockwise about shaft 42, as shown in FIG. 9(*b*) and FIG. 5. As a result, the pinion gear 46 engages the crank gear 22, causing the crank gear 22 to rotate clockwise. As the crank gear 22 rotates clockwise, the link 24 is driven towards the right so as to raise the lifter 28, thereby raising the forward end of pressure plate 11 as shown in FIG. 7(*a*). The forces created in the gear train also apply a clockwise rotational force to pick arm 60, urging engagement of the pinion gear 58 with the pick gear 18. However, the pick arm 60 is prevented from rotating enough to engage the gears by means of lower arm 70, which rides along a ridge 72 formed on the backside of the crank gear 22 along a portion of the gear's outer circumference as shown in FIGS. 8(*a*) and 10.

Pinion gear 46 continues to drive crank gear 22 until the lifter 28 is fully-raised, as shown in FIGS. 7(*a*)–(*b*) and 9(*a*)–(*b*). As the lifter 28 is being raised, the pinion gear 46 continues to rotate the crank gear 22 until pinion gear 46 reaches a recess 74, which is formed in the crank gear 22 at about one-half of the gear teeth depth. At this point, the crank gear 22 can no longer be driven forward by gear 46. In synchrony, the pick arm 60 rotates about the shaft 42 to engage the pinion gear 58 with the pick gear 18. This is shown in FIGS. 7(*a*)–(*b*) and 9(*a*)–(*b*). At this point in its rotation, the ridge 72 on crank gear 22 has rotated relative to the lower arm 70 so that it no longer prevents lower arm 70 (and therefore pick arm 60) from rotating, permitting the pick arm 60 to rotate until lower arm 70 rides along inner ridge 76, whereby the pinion gear 58 and the pick gear 18 are engaged. A detent 78 (FIG. 10) is cut into inner ridge 76 so that a protrusion 80 along leaf spring 82 engages the detent 78, thereby locking the rotation of the crank gear 22 (the leaf spring and protrusion are removed from FIG. 10 for clarity).

Once the pressure plate 11 has been raised to a paper-up position, the motor continues to rotate in the counterclockwise direction, causing the gear train to rotate pick gear 18 in the clockwise direction, thereby rotating pick rollers 12 via shaft 16.

Figure 11:
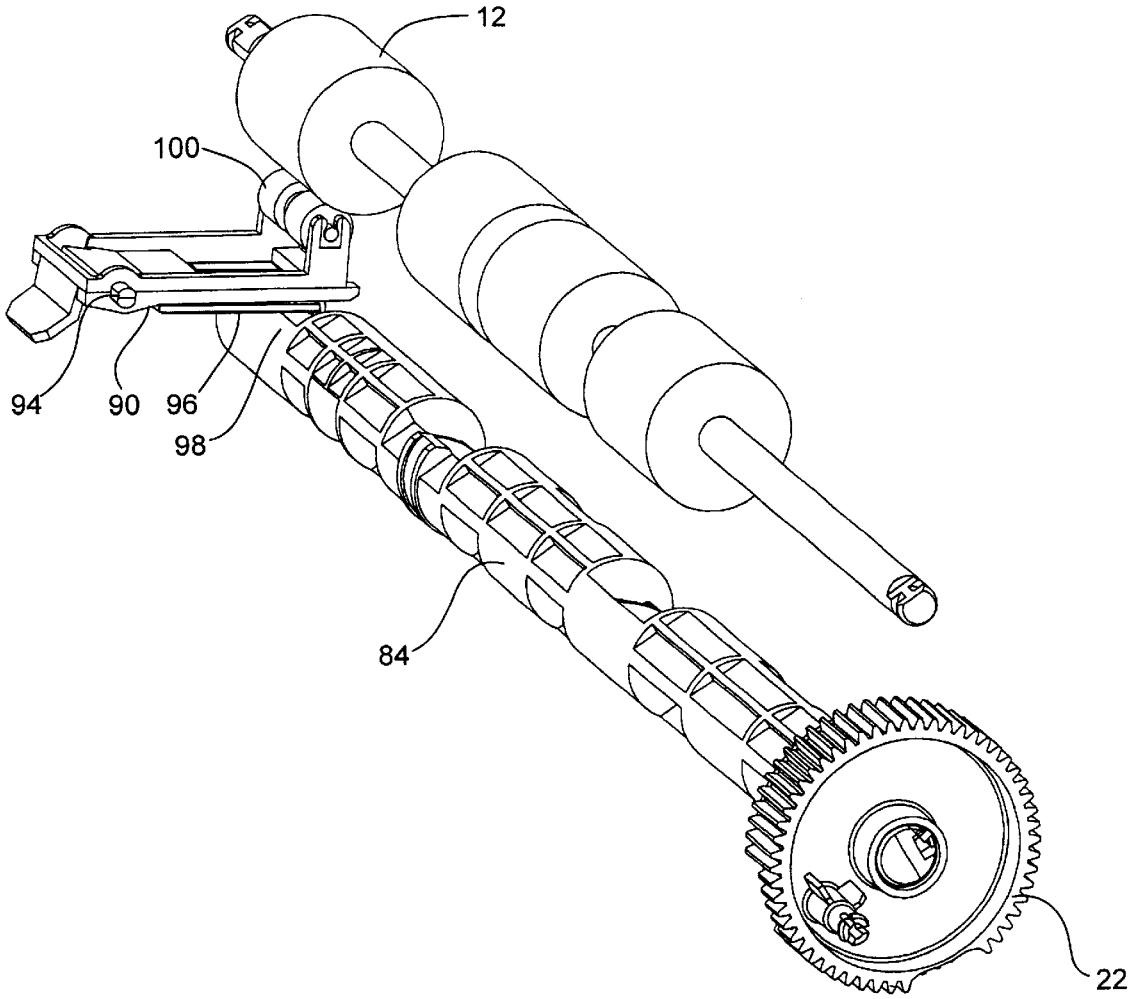
FIG. 11 is an isometric view of one of the pinch roller assemblies of the FIG. 4 apparatus.

The operation of the pinch roller assembly will now be described. Referring to FIG. 11, a camshaft 84 is concentrically mounted to crank gear 22, and rotates about bearings at its respective ends (not shown). Pinch roller frame 90 is pivotally mounted to chassis 10 (not shown) at pivots 94. A leaf spring 96 is mounted to the underside of pinch-roller frame 90. As the camshaft 84 is rotated clockwise a cam surface 98 engages the leaf spring 96, causing the roller frame 90 to rotate about pivots 94 in a counterclockwise direction until a pinch roller 100 comes into contact with a pick roller 12. When the crank gear 22 is locked in the paper-up position the cam surface 98 displaces the leaf spring 96 so that a constant force is applied by the pinch roller 100 to the pick roller 12 along a line of contact formed between the two cylindrical bodies.

Figure 12:
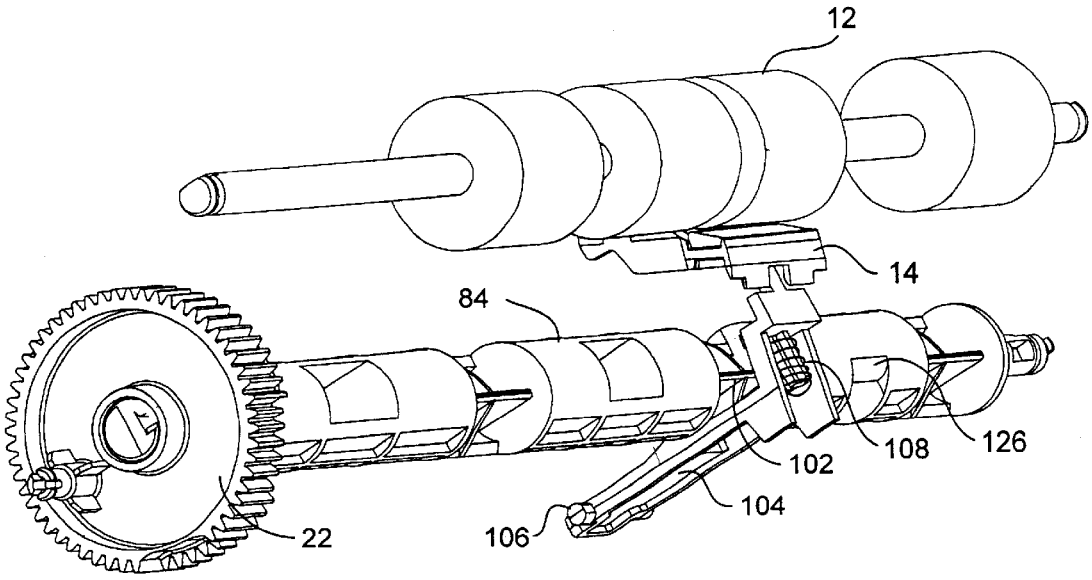
FIG. 12 is an isometric view of the separator assembly.
Figure 15:
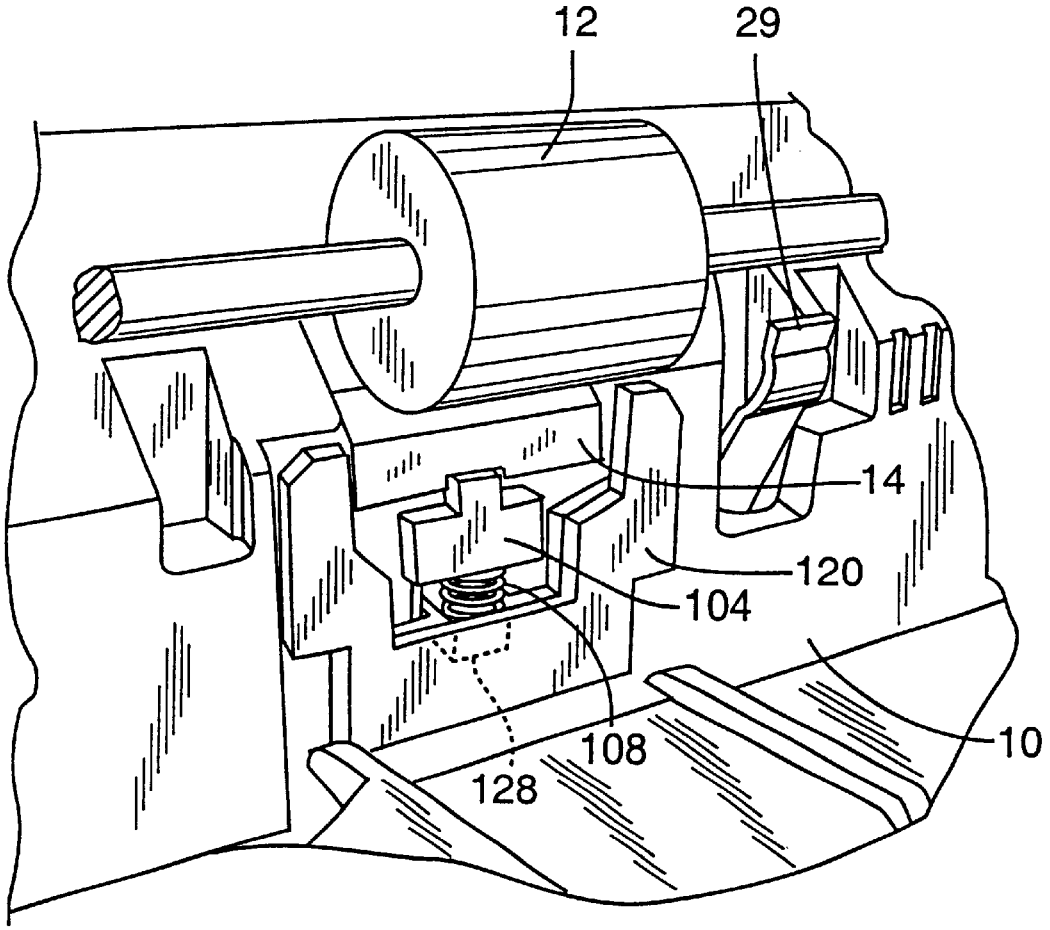
FIG. 15 is an isometric view of the separator and media retarder.

The operation of the separator assembly is similar to the pinch roller assembly operation. Details of the separator assembly are shown in FIGS. 12 and 15. Referring to FIG. 12, the camshaft 84 has a cam surface 102 formed on its underside, which allows lift 104 to rotate about pivots 106 in a counterclockwise direction as camshaft 84 is rotated clockwise. Lift 104 is biased to rotate counterclockwise about pivots 106 by spring 108 which is situated in a well 128 formed in the chassis 10 (FIG. 15). The lift 104 contacts the separator 14 at its underside, urging the separator 14 to rotate about a pair of opposed pivots that are suitably mounted in the chassis 10 (not shown) in a counterclockwise direction as the lift 104 is raised.

Figure 13A:
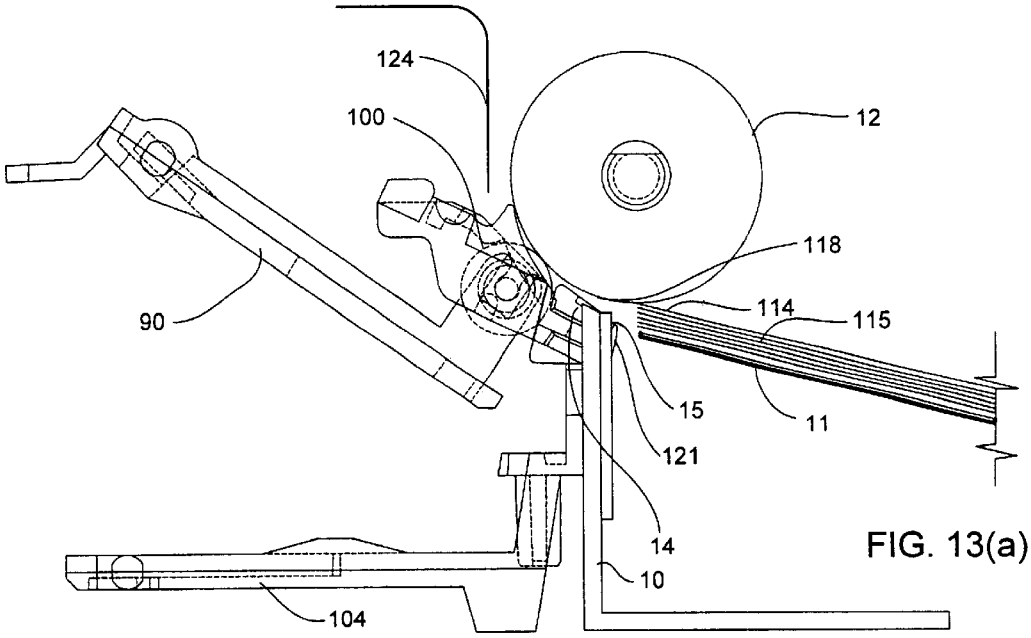
FIGS. 13(*a*) and 13(*b*) are elevational views of the media delivery path during a pick operation.
Figure 13B:
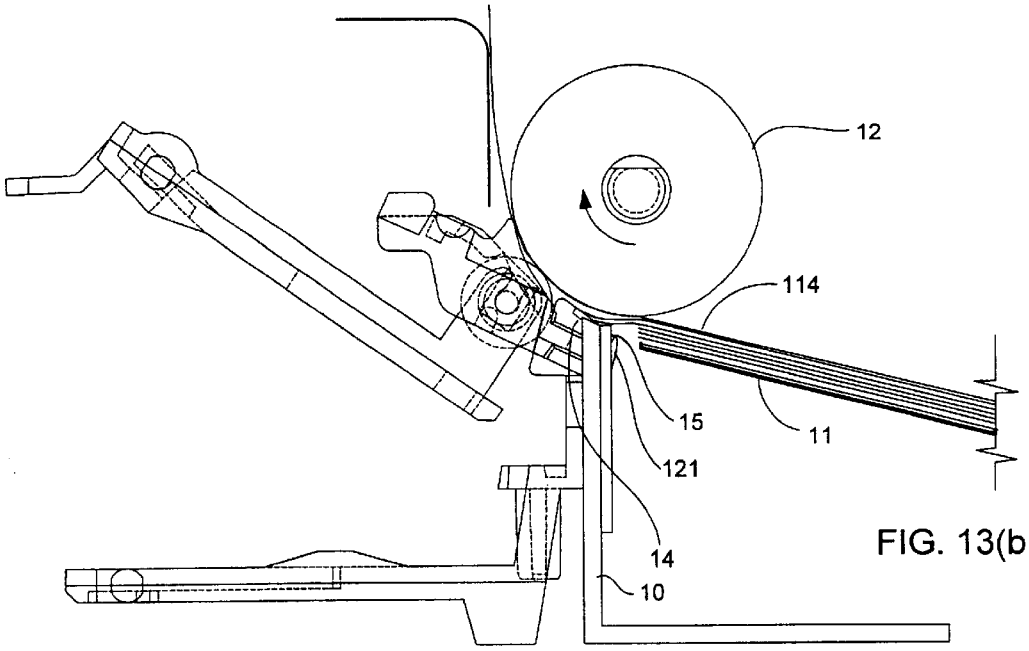
Figure 13C:
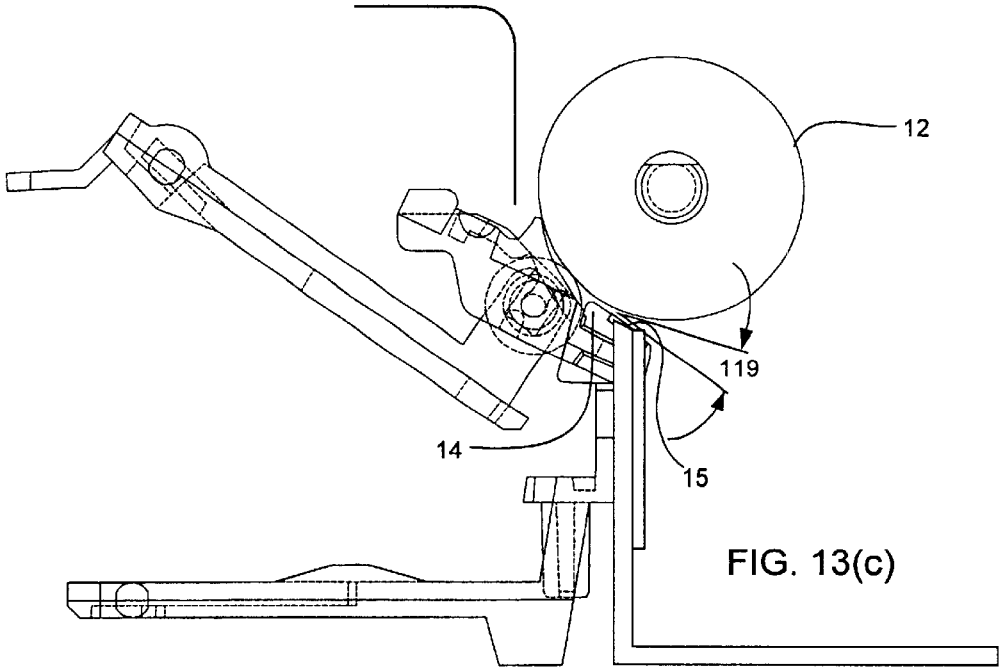

As the pressure plate 11 is being raised by the lifter 28, the top leading edge of a top sheet of media 114 is pushed against the underside of the pick rollers 12, as shown in FIGS. 13(*a*)–(*b*). As shown in FIGS. 6(*a*)–7(*b*), the rocker 26 is connected to a shaft 31. The lifter 28 is connected to a torsion spring 27 (FIG. 4) which is situated concentrically about the shaft 31 and connected to the rocker 26 so that a bias spring force is applied to a media stack 115 (and thus to media sheet 114) when the media stack 115 presses against the pick rollers 12. When the lift 104 is at its maximum height position, a throat 118 (FIG. 13(*a*)) is formed between a separator pad 15, which is situated on top of the separator 14, and one of the pick rollers 12, as shown in FIG. 13(*b*). The pick roller 12 contacts the separator pad 15 to form the back of the throat 118.

As shown in FIG. 13(*a*), the pressure plate 11 is in the paper-up position, with the top sheet pressed against the pick rollers 12. In FIG. 13(*b*) the top sheet 114 is pulled into the throat 118 by the pick roller 12, eventually passing over the separator pad 15. The separator pad 15 is used to prevent more than one sheet of media from advancing through the throat 118 at a time. The separator pad 15 is preferably made of an elastomer such as rubber, with a Shore-A durometer of 50–90. The pick roller 12 is preferably made of an ethylene-propylene diene monomer with a durometer of about 35. The softer pick roller 12 creates more friction against the top surface of the top sheet 114 than is created between the bottom of the top sheet and separator pad 15 so that the top sheet 114 is pulled past the separator pad 15, whereby its leading edge enters the nip formed between the pick roller 12 and the pinch rollers 100 and is advanced upward against frame 124.

As the top sheet 114 is dragged by the pick roller, frictional forces between the top sheet and underlying sheets may urge the underlying sheets to enter the throat 118, as shown in FIG. 13(*b*). At this point, the rubber surface of the separator pad 15 creates enough friction between itself and the underlying media sheets to overcome the friction created between the top sheet and any underlying sheets, thereby separating the sheets of media.

The separator performance is highly dependent on the size of the throat 118, and the media incidence angle 119 (FIG. 13(*c*)), which is the angle between the entering media and the separator pad at the point of tangency to the pick roller. There is a tradeoff between the size of the front of the throat opening and the angle of incidence 119. A larger throat opening admits thicker or wavier media, but usually requires a steeper incidence angle, which leads to media "stubbing," as explained below.

In many conventional feeders the pick roller is about 52 mm in diameter, which results in a smaller incidence angle for the same size throat opening. Conversely, the pick roller 12 is preferably about 22 mm in diameter, which requires the use of a steeper incidence angle 119 to create a throat opening that is large enough to provide proper separation. Even with the steeper incidence angle, the throat opening is still limited by the smaller-size pick roller. As a result, imperfect media has a tendency to "stub" as it passes over the separator 14 and separator pad 15. For example, if the leading edge of a media sheet is wavy, the sheet may tend to stub against the front surface 121 of the separator 14 as it is urged forward by the pick roller 12. In order to reduce this "stubbing" effect, the front surface 121 must be made of a low-friction material, preferably a polymer such as nylon. Such a low-friction material allows the media to slip over the front part of the separator 14 without stubbing.

A second type of stubbing is caused by the larger incidence angle. In this instance, the larger incidence angle tends to cause the leading edge of the sheet to curl downward and stub against the separator pad as it enters the back of the throat. In order to overcome this problem, the front edge of the media needs to be flattened, which is accomplished when the media stack is pressed against the underside of the pick rollers prior to picking the media.

Figure 14A:
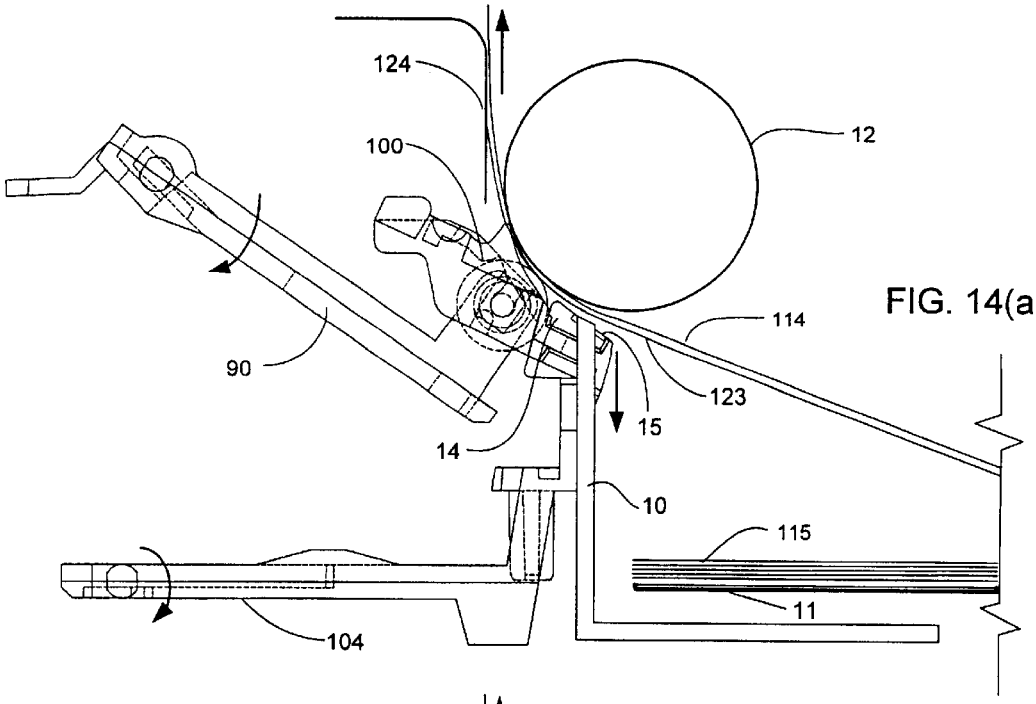
FIGS. 14(*a*) and 14(*b*) are elevational views of the media delivery path showing the effect of the media retarder.
Figure 14B:
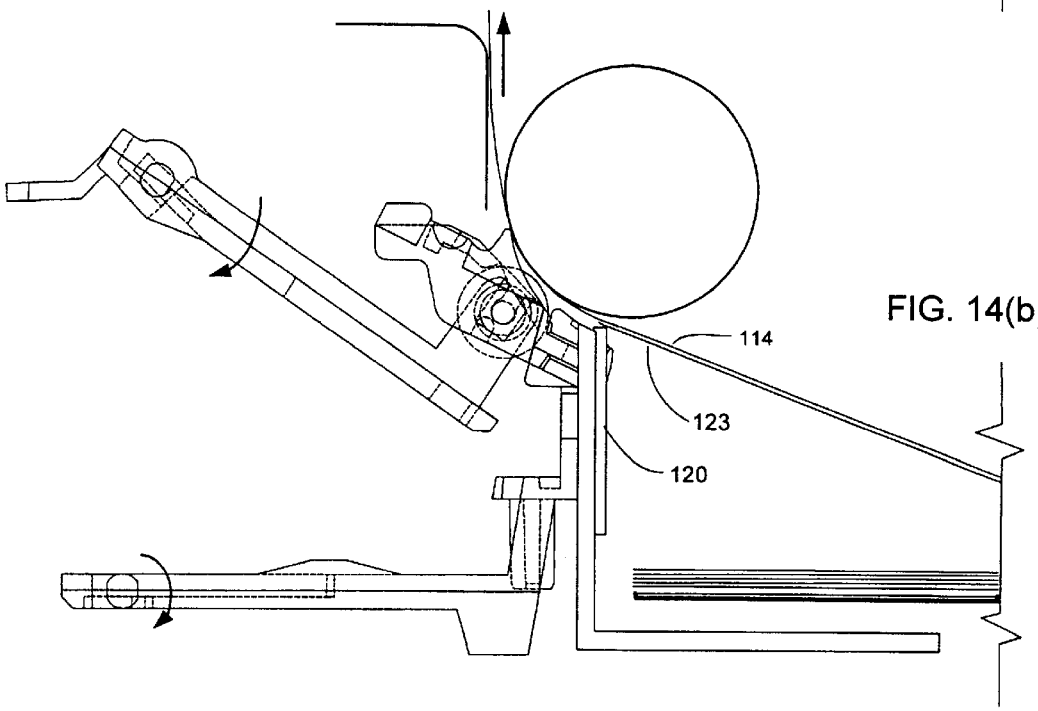

As the leading edge of the top sheet is pulled upwardly it is fed into a second printer feed mechanism (not shown). In order to prevent skewing and other adverse feeding effects, it is desirable to remove the frictional forces acting on the media at the separator pad and between the pick rollers and pinch rollers. Thus, as the media is fed into the second printer feed mechanism, the media separator 14 and pinch rollers 100 are retracted so that they are no longer in contact with the pick rollers 12, as shown in FIGS. 14(*a*)–(*b*). The effect of retracting the media separator 14 is shown in FIG. 14(*a*). As the front of the media separator 14 is lowered, there may be enough friction between the first sheet 114 and the second sheet 123 to cause the second sheet to pass over the separator pad 15 (which has been retracted from the pick roller 12), and continue up the media transport path, resulting in a trailing pick. One device for reducing trailing picks, found in conventional feeders having large (i.e. about 52 mm) pick rollers, is a media separator that has a front surface 121 (FIGS. 13(*a*)–(*b*)) made of an elastomer. As the second sheet is dragged by the first, it first must pass over the front surface 121 of the separator. Because this surface is made of an elastomer, the friction between the bottom side of the second sheet exceeds the friction between the two sheets, thereby retarding advancement of the second sheet up the media transport path. However, as discussed above, the reduced throat size necessitates the use of a low-friction material for the front surface 121. A downside of the low-friction surface is that it does not provide enough friction to prevent trailing picks.

In order to reduce the likelihood of trailing picks, the preferred embodiment incorporates the use of the media retarder 120, which protrudes above the level of the retracted separator pad, as shown in FIGS. 14(*b*) and 15. The media retarder is preferably made of an elastomer with a durometer in the range of 50–90. As the second sheet 123 is dragged by the top sheet 114 it is stopped by the friction between the media retarder 120 and itself, which is greater than the friction between the two sheets of media.

As the top sheet advances through the media transport path a media edge sensor (not shown) is used to determine when the media has advanced into engagement with a conventional printer media feed mechanism (not shown) associated with the printer. At this point, the sensor signals the motor controller to rotate the motor clockwise, causing the pinch rollers 100 and the separator 14 and the pressure plate 11 to be retracted, and disengaging the pick gear 18 so that the sheet can be advanced into the printer with minimal drag forces caused by the media delivery apparatus.

Figure 10:
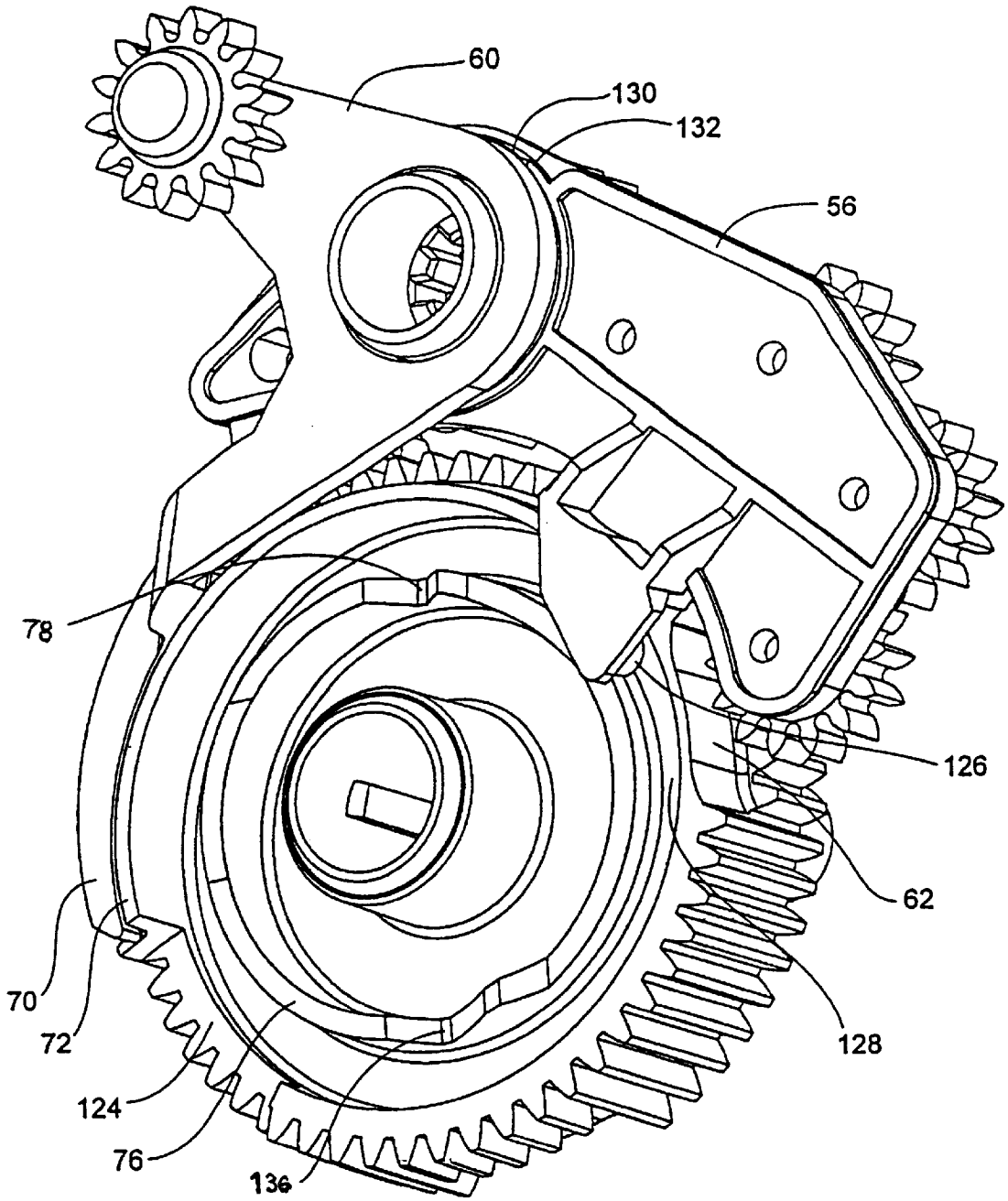
FIG. 10 shows an isometric view of the backside of the drive mechanism gear assembly.

Retraction of the pinch rollers 100 and the separator 14 is accomplished by rotating the crank gear 22 clockwise, which in turn rotates the camshaft 84 clockwise. As the camshaft rotates, cam surfaces 98 (FIG. 11) provide a decrease in the cam diameter adjacent to the pinch roller frames 94 and cam surface 102 provides an increase in the cam diameter adjacent to the lift 104, thereby causing the pinch rollers 100 and separator 14 to retract. In synchrony with this action, the lifter 28 and pressure plate II are lowered. The rotation of the crank gear 22 is shown in FIGS. 6(*a*)–9(*b*). The motor 30 is rotated clockwise, causing the crank arm 56 to rotate about the shaft 42 so that the gear 54 engages with the crank gear 22. A notch 124 is cut into the backside of the crank gear 22 so that a farside protrusion 126 can swing into a groove 128 that is formed in the backside of crank gear 22, as shown in FIG. 10. As the crank arm 56 rotates, a tab 130 on the crank arm contacts the wall of a recess 132 in the pick arm 60 (see FIG. 10) so as to cause the pick arm 60 to rotate counter-clockwise about the shaft 42, disengaging the pinion gear 58 from the pick gear 18. This allows the pick rollers 12 to freely rotate with little resistance. As the motor 30 rotates clockwise the resultant action of the gear train causes the gear 54 to rotate counterclockwise, causing the crank gear 22 to rotate clockwise. As the crank gear 22 rotates clockwise, the pivot 64 moves to the left (as viewed in FIGS. 6(*a*)–7(*b*)) so as to lower the lifter 28 and pressure plate 11. At the same time, the camshaft 84 is rotated clockwise, rotating the cam surfaces 98 and 102, thereby causing the pinch rollers 100 and the separator 14 to be retracted away from the pick rollers 12. The crank gear 22 continues to rotate clockwise until pinion gear 54 reaches relief 62, at which point the protrusion 80 on leaf spring 82 falls into a second detent 136 (see FIGS. 8(*a*) and 10). This locks the crank gear 22 in the paper-down position.

As shown in FIG. 4, the media delivery apparatus may also incorporate the use of a paper kicker 29, which is used to align the leading edges of the media sheets. The paper kicker 29 is hingedly mounted in the chassis 10, and spring-biased in an upward position. The position of the paper kicker 29 is controlled by the position of the cam 84, whereby the cam 84 provides a cam surface 126 (see FIG. 12) for actuating the paper kicker 29.

In the illustrated embodiment, all of the gears preferably are made from an acetal polymer such as Delrin, with the exception of the drive gear 32, which is preferably made of metal. The majority of all of the other components preferably are made from suitable engineering thermoplastics by injection molding or other suitable processes, except for the springs, which are made out of suitable spring steels, and the motor mount, which is made of metal.

Experimental Results

Experimental results have shown significant improvements over the prior art. When the leading edge of the media stack is pressed against the pick rollers prior to being picked, the pick rollers flatten out any waves that are in the areas where the pick rollers contact the media. As a result, sheet media damage incidence has been reduced by a factor of 20. In addition, the life of the separator pad and its adjacent pick roller have been significantly extended because the pick roller is no longer rubbing against the separator pad for an extended period prior to picking a media sheet. Experimental results have also shown that the peak torque loading requirement has been reduced by 30%. Since the pick rollers are not driven until the pressure plate is fully lifted, the media stack-lift and media feed loads are no longer superimposed. The reduced torque load requirements provides for increased motor life and/or reduction in motor size and energy requirements. Experimental results have also shown a significant reduction in multi-picks and trailing picks due to the combined use of the media separator and the media retarder.

Having described the principles of our invention with reference to a preferred embodiment, it should be apparent that the invention can be modified in arrangement and detail without departing from such principles. For example, while the illustrated embodiment uses a crank arm and pick arm to engage and disengage the crank gear and the pick gear, respectively, this could also be accomplished by providing electronic clutches somewhere in the gear trains that drive the crank gear and the pick gear. Additionally, the gear trains could be replaced by drive belts and pulleys. Many other such variations will be apparent to those skilled in the art.

In view of the many embodiments to which the principles of our invention can be applied, it should be understood that the detailed embodiment is exemplary only and should not be taken as limiting the scope of our invention. Rather, we claim as our invention all such embodiments as may fall within the scope and spirit of the following claims, and equivalents thereto.

We claim:

1. An apparatus for delivery of sheet media to a printer, comprising:

a chassis;

a drive motor mounted to the chassis;

a media tray mountable to the chassis;

a plurality of pick rollers commonly mounted on a drive shaft, the drive shaft being rotatably mounted at opposite ends to the chassis and operatively coupled to the drive motor;

a plurality of pinch rollers situated opposite the pick rollers;

a pinch roller positioning mechanism operatively coupled to the drive motor for extending and retracting the pinch rollers, the pinch rollers being in parallel contact with the pick rollers when in an extended position, and being spaced from the pick rollers when in a retracted position;

a pressure plate having a forward end, situated in the media tray;

a lifting mechanism operatively coupled to the drive motor for lifting the forward end of the pressure plate;

a retractable separator;

a separator positioning mechanism operatively coupled to the drive motor for extending and retracting the separator, the separator when extended being in contact with at least one of the pick rollers, and when retracted forming a gap with at least one of the pick rollers; and a media retarder mounted to the chassis in close proximity to the separator so as to reduce trailing picks;

wherein each pinch roller is mounted in a pinch roller frame pivotally connected to the chassis, the pinch roller positioning mechanism including:

a camshaft having a plurality of cam surfaces, the cam surfaces being in contact with the pinch roller frames, the camshaft being operatively coupled to the motor by a transmission for rotating the camshaft, the rotation of the camshaft causing the cam surfaces to urge the pinch roller frames to rotate about their pivotal connections, and thereby causing the pinch rollers to be extended and retracted.

2. The apparatus of claim 1, wherein the transmission includes a plurality of meshed gears coupling the motor to the camshaft.

3. The apparatus of claim 1, wherein the pinch rollers can be locked into the extended or retracted position by a detent mechanism that locks the rotational position of the camshaft.

4. The apparatus of claim 1, wherein the separator can be locked into the extended or retracted position by a detent mechanism that locks the rotational position of the camshaft.

5. The apparatus of claim 1, further comprising a paper kicker, the paper kicker being pivotally mounted to the chassis and operatively coupled to the single drive motor by the camshaft, wherein a cam surface on the camshaft urges the paper kicker to rotate about the pivotal connection.

6. An apparatus for delivery of sheet media to a printer, comprising:

a chassis;

a drive motor mounted to the chassis;

a media tray mountable to the chassis;

a plurality of pick rollers commonly mounted on a drive shaft, the drive shaft being rotatably mounted at opposite ends to the chassis and operatively coupled to the drive motor;

a plurality of pinch rollers situated opposite the pick rollers;

a pinch roller positioning mechanism operatively coupled to the drive motor for extending and retracting the pinch rollers, the pinch rollers being in parallel contact with the pick rollers when in an extended position, and being spaced from the pick rollers when in a retracted position;

a pressure plate having a forward end, situated in the media tray;

a lifting mechanism operatively coupled to the drive motor for lifting the forward end of the pressure plate;

a retractable separator;

a separator positioning mechanism operatively coupled to the drive motor for extending and retracting the separator, the separator when extended being in contact with at least one of the pick rollers, and when retracted forming a gap with at least one of the pick rollers; and a media retarder mounted to the chassis in close proximity to the separator so as to reduce trailing picks;

wherein the drive shaft is operatively coupled to the drive motor via a transmission, the transmission being able to drive the drive shaft when the separator is extended, the transmission being disengaged from the drive shaft when the separator is not extended.

7. A method of advancing sheet media into a printer from a sheet media delivery apparatus including a plurality of pick rollers, a plurality of moveable pinch rollers, and a media stack having a top sheet, comprising the steps:

(a) raising the media stack so that the top sheet is urged into contact with the pick rollers;

(b) extending the pinch rollers until they are in contact with the pick rollers, thereby forming a roller assembly with a nip therebetween;

(c) starting rotation of the pick rollers after the media stack is fully raised and the pinch rollers contact the pick rollers so as to pick the top sheet of media; and (d) continuing to rotate the pick rollers so as to transport the top sheet through the roller assembly into the printer.

8. The method of claim 7, wherein the top sheet has a leading edge and the media is urged into contact with sufficient force in step (a) so as to flatten the leading edge to reduce stubbing.

9. The method of claim 7, wherein steps (a) and (b) are performed in synchrony.

10. The method of claim 9, wherein the top sheet has a leading edge, and the pick rollers are rotated by a drive mechanism, further comprising the steps:

sensing when the leading edge of the top sheet has advanced to a predetermined point;

retracting the pinch rollers away from the pick rollers;

retracting the separator away from the pick roller opposite the separator; and releasing the pick roller drive mechanism so that the pick rollers can freely rotate.

11. The method of claim 7, wherein the delivery apparatus includes a separator proximate one of the pick rollers, and further adding the following step prior to step (c):

moving the separator until it contacts the pick roller to form a throat between the separator and the pick roller.

12. The method of claim 7, wherein the top sheet has a leading edge, and the pick rollers are rotated by a drive mechanism, further comprising the steps:

(e) sensing when the leading edge of the top sheet has advanced to a predetermined point;

(f) retracting the pinch rollers away from the pick rollers; and (g) releasing the pick roller drive mechanism so that the pick rollers can freely rotate.

13. An apparatus for delivering sheet media to a printer, comprising:

a chassis;

a media tray for holding the sheet media;

a plurality of pick rollers mounted for rotation along a common axis of rotation;

at least one retractable separator located proximate one of the pick rollers, the separator when extended contacting one of the pick rollers to form a throat therebetween to receive one of the sheet media, the separator when retracted being spaced from the pick roller;

an actuator to urge the media tray and sheet media supported therein into pressure contact with the pick rollers while preventing rotation of the pick rollers until the sheet media is in full pressure contact with the pick rollers; and the actuator operating to initiate rotation of the pick rollers once the sheet media has achieved full pressure contact with the pick rollers so as to advance one of the sheet media into the throat.

14. The apparatus of claim 13 further including:

a plurality of pinch rollers cooperable with the pick rollers to advance a sheet of media to the printer;

an elastomeric media retarder located proximate to the separator and pick roller, the media retarder being positioned so as not to interfere with the feeding of the sheet of media when the separator is extended but serving to retard feeding of trailing sheet media when the separator is retracted.

15. An apparatus for delivery of sheet media to a printer, comprising:

a chassis;

a drive motor mounted to the chassis;

a media tray mountable to the chassis;

a plurality of pick rollers commonly mounted on a drive shaft, the drive shaft being rotatably mounted at opposite ends to the chassis, and operatively coupled to the drive motor;

a plurality of pinch rollers situated opposite the pick rollers;

a pinch roller positioning mechanism operatively coupled to the drive motor for extending and retracting the pinch rollers, the pinch rollers being in parallel contact with the pick rollers when in an extended position, and being spaced from the pick rollers when in a retracted position;

a pressure plate having a forward end, situated in the media tray;

a lifting mechanism operatively coupled to the drive motor for lifting the forward end of the pressure plate;

a retractable separator;

a separator positioning mechanism operatively coupled to the drive motor for extending and retracting the separator, the separator when extended being in contact with at least one of the pick rollers, and when retracted forming a gap with at least one of the pick rollers; and a media retarder mounted to the chassis in close proximity to the separator so as to reduce trailing picks;

wherein the pinch roller positioning mechanism and separator positioning mechanism are decoupled from the drive motor once the pinch roller and separator are extended.

16. An apparatus for delivery of sheet media to a printer, comprising:

a chassis;

a drive motor mounted to the chassis;

a media tray mountable to the chassis;

a plurality of pick rollers commonly mounted on a drive shaft, the drive shaft being rotatably mounted at opposite ends to the chassis, and operatively coupled to the drive motor;

a plurality of pinch rollers situated opposite the pick rollers;

a pinch roller positioning mechanism operatively coupled to the drive motor for extending and retracting the pinch rollers, the pinch rollers being in parallel contact with the pick rollers when in an extended position, and being spaced from the pick rollers when in a retracted position;

a pressure plate having a forward end, situated in the media tray;

a lifting mechanism operatively coupled to the drive motor for lifting the forward end of the pressure plate;

a retractable separator;

a separator positioning mechanism operatively coupled to the drive motor for extending and retracting the separator, the separator when extended being in contact with at least one of the pick rollers, and when retracted forming a gap with at least one of the pick rollers; and a media retarder mounted to the chassis in close proximity to the separator so as to reduce trailing picks;

wherein the drive shaft is operatively coupled to the drive motor via a transmission, the transmission being able to drive the drive shaft when the pinch roller positioning mechanism is extended, the transmission being disengaged from the drive shaft when the pinch roller positioning mechanism is not extended.

17. An apparatus for delivery of a media stack having a top sheet to a printer, the apparatus having a plurality of pick rollers and a plurality of movable pinch rollers, comprising:

means for raising the media stack so that the top sheet is urged into contact with the pick rollers;

means for extending the pinch rollers until they are in contact with the pick rollers, thereby forming a roller assembly with a nip therebetween;

means for starting rotation of the pick rollers after the media stack is fully raised and the pinch rollers contact the pick rollers so as to pick the top sheet of media; and means for continuing to rotate the pick rollers so as to transport the top sheet through the roller assembly into the printer.

* * * * *